US011754331B2

(12) United States Patent
Trammell et al.

(10) Patent No.: US 11,754,331 B2
(45) Date of Patent: Sep. 12, 2023

(54) DIVIDER PANEL FOR HVAC SYSTEM

(71) Applicant: Johnson Controls Technology Company, Auburn Hills, MI (US)

(72) Inventors: Curtis A. Trammell, Newcastle, OK (US); Curtis W. Caskey, Dallastown, PA (US); Roderick R. Sentz, Spring Grove, PA (US); Zhiwei Huang, Moore, OK (US); Gregory Ulizio, Oklahoma City, OK (US)

(73) Assignee: JOHNSON CONTROLS TYCO IP HOLDINGS LLP, Milwaukee, WI (US)

( * ) Notice: Subject to any disclaimer, the term of this patent is extended or adjusted under 35 U.S.C. 154(b) by 796 days.

(21) Appl. No.: 16/664,395

(22) Filed: Oct. 25, 2019

(65) Prior Publication Data

US 2021/0123649 A1 Apr. 29, 2021

(51) Int. Cl.

| | |
|---|---|
| ***F25B 39/04*** | (2006.01) |
| ***F24F 1/16*** | (2011.01) |
| ***F24F 1/46*** | (2011.01) |
| ***F24F 1/56*** | (2011.01) |
| ***F25B 49/02*** | (2006.01) |
| ***F24F 1/38*** | (2011.01) |

(52) U.S. Cl.

CPC ..... *F25B 49/027* (2013.01); *F24F 1/16* (2013.01); *F24F 1/38* (2013.01); *F24F 1/46* (2013.01); *F25B 39/04* (2013.01); *F24F 1/56* (2013.01); *F25B 2339/04* (2013.01)

(58) Field of Classification Search

CPC .... F25B 49/027; F25B 39/04; F25B 2339/04; F24F 1/06; F24F 1/16; F24F 1/38; F24F 1/40; F24F 1/46; F24F 1/48; F24F 1/50; F24F 1/52; F24F 1/54; F24F 1/56; F24F 1/58; F24F 2009/002

See application file for complete search history.

(56) References Cited

U.S. PATENT DOCUMENTS

| | | | | | |
|---|---|---|---|---|---|
| 2,945,359 | A * | 7/1960 | MacLeod | F24F 1/031 | 62/262 |
| 2,945,360 | A * | 7/1960 | Tyler | F24F 8/108 | 62/262 |
| 3,766,749 | A * | 10/1973 | Livesay | F24F 1/027 | 62/262 |
| 5,069,040 | A * | 12/1991 | Walker | F25B 49/027 | 62/181 |
| 9,557,070 | B2 | 1/2017 | Song et al. | | |
| 2005/0076663 | A1 * | 4/2005 | Goodman | F24F 1/18 | 62/298 |

(Continued)

FOREIGN PATENT DOCUMENTS

| | | | | |
|---|---|---|---|---|
| CN | 203810594 U | * | 9/2014 | F24F 1/50 |
| CN | 203823951 U | * | 9/2014 | F24F 1/50 |

(Continued)

*Primary Examiner* — Miguel A Diaz

(74) *Attorney, Agent, or Firm* — Fletcher Yoder, PC

(57) ABSTRACT

A heating, ventilation, and/or air conditioning (HVAC) system includes a condenser section and a plurality of panels configured to abut one another in a common plane to form a divider panel assembly. Each panel of the plurality of panels is sequentially insertable into and removable from the condenser section.

25 Claims, 13 Drawing Sheets

(56) References Cited

U.S. PATENT DOCUMENTS

| | | | | |
|---|---|---|---|---|
| 2008/0060790 | A1* | 3/2008 | Yates | H05K 7/20754 361/679.48 |
| 2009/0098820 | A1 | 4/2009 | Yabu | |
| 2009/0108717 | A1* | 4/2009 | Jang | F24F 1/50 312/100 |
| 2010/0267326 | A1* | 10/2010 | Back | E06B 7/10 454/212 |
| 2016/0187006 | A1* | 6/2016 | Koo | F24F 1/22 62/508 |
| 2018/0224136 | A1 | 8/2018 | Goel | |
| 2020/0269172 | A1* | 8/2020 | Singh | F24F 8/10 |
| 2021/0239332 | A1* | 8/2021 | Suvvada | F24F 1/22 |

FOREIGN PATENT DOCUMENTS

| | | | | | |
|---|---|---|---|---|---|
| CN | 204063353 | U | * | 12/2014 | F24F 1/22 |
| EP | 2503257 | A1 | * | 9/2012 | F24F 1/027 |
| EP | 3054225 | A1 | * | 8/2016 | F24F 1/16 |
| KR | 200146084 | Y1 | * | 6/1999 | |
| KR | 200146085 | Y1 | * | 6/1999 | |
| KR | 20010054777 | A | * | 7/2001 | |
| WO | WO-2018011071 | A1 | * | 1/2018 | B65D 88/745 |

* cited by examiner

DIVIDER PANEL FOR HVAC SYSTEM

BACKGROUND

This section is intended to introduce the reader to various aspects of art that may be related to various aspects of the present disclosure and are described below. This discussion is believed to be helpful in providing the reader with background information to facilitate a better understanding of the various aspects of the present disclosure. Accordingly, it should be noted that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. An HVAC system may control the environmental properties through control of a supply air flow delivered to the environment. For example, the HVAC system may place the supply air flow in a heat exchange relationship with a refrigerant of a vapor compression circuit to condition the supply air flow. The HVAC system may include a heat exchanger having fans that are independently controllable to cool the refrigerant and enable the cooled refrigerant to absorb thermal energy from the supply air flow, thereby cooling the supply air flow. In some embodiments, the fans may share a volume of space to force or draw air across heat exchanger coils through which the refrigerant flows. In some circumstances, suspending operation of a subset of the fans may reduce an efficiency of fans that remain in operation to cool the refrigerant. As a result, the efficiency of the HVAC system to condition the supply air flow may be reduced.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heating, ventilation, and/or air conditioning (HVAC) system includes a condenser section and a plurality of panels configured to abut one another in a common plane to form a divider panel assembly. Each panel of the plurality of panels is sequentially insertable into and removable from the condenser section.

In another embodiment, a divider panel assembly for a heating, ventilation, and/or air conditioning (HVAC) system includes a plurality of panels and a plurality of braces. The plurality of panels are configured to abut one another, and each panel of the plurality of panels includes a respective hook portion configured to engage with a support rail of a condenser section of the HVAC system. Further, each brace of the plurality of braces is configured to couple to a respective panel of the plurality of panels and configured to capture the support rail between a respective brace and panel.

In another embodiment, a condenser section of a heating, ventilation, and/or air conditioning (HVAC) system includes a fan deck, a support rail coupled to the fan deck and having a channel with a J-shape, and a panel of a divider panel assembly that is insertable into the condenser section and removable from the condenser section. The panel includes a hook portion configured to slidably insert into the channel to engage the panel with the support rail.

DRAWINGS

Various aspects of this disclosure may be better understood upon reading the following detailed description and upon reference to the drawings in which.

Figure 12:
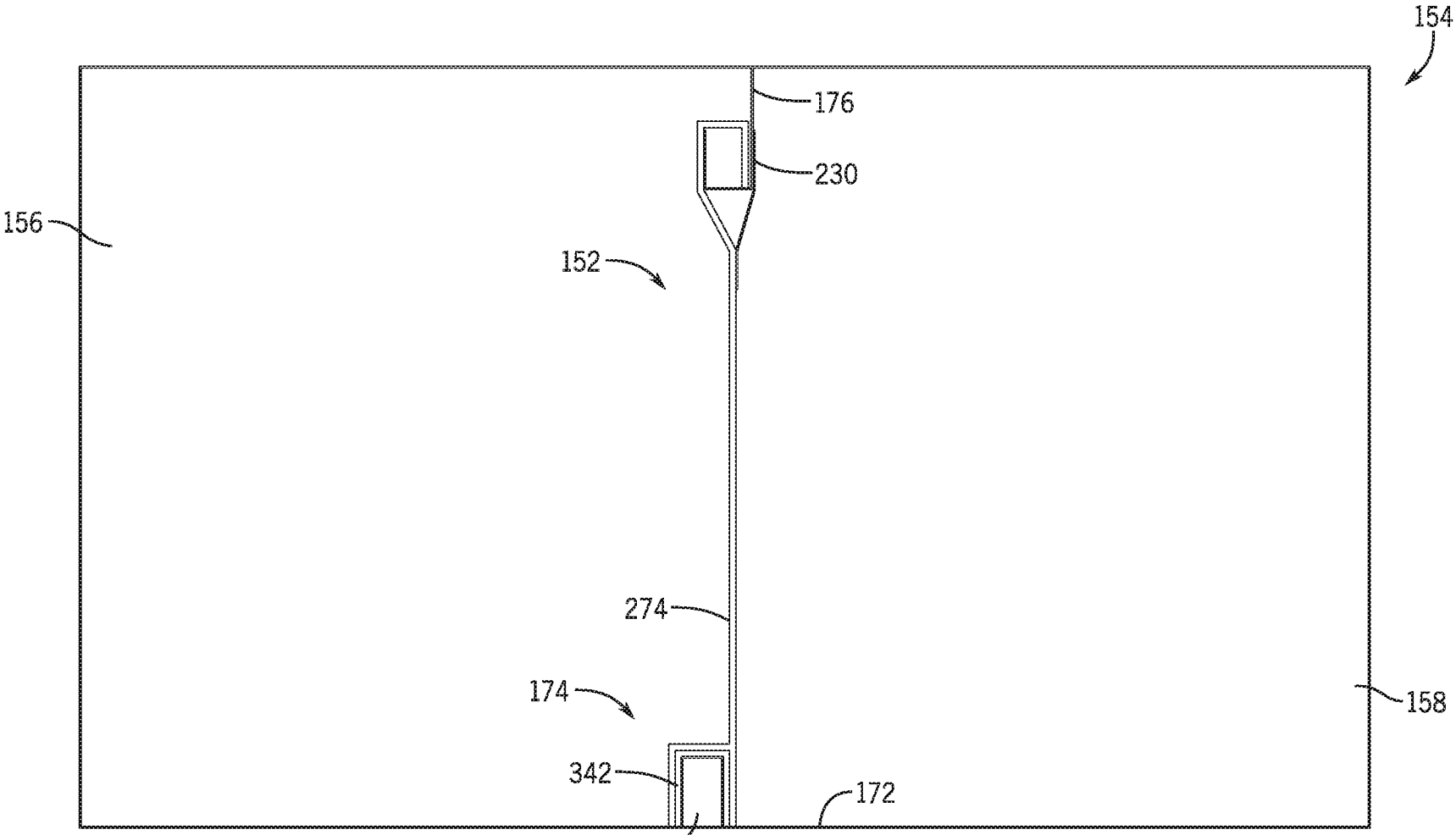
Figure 13:
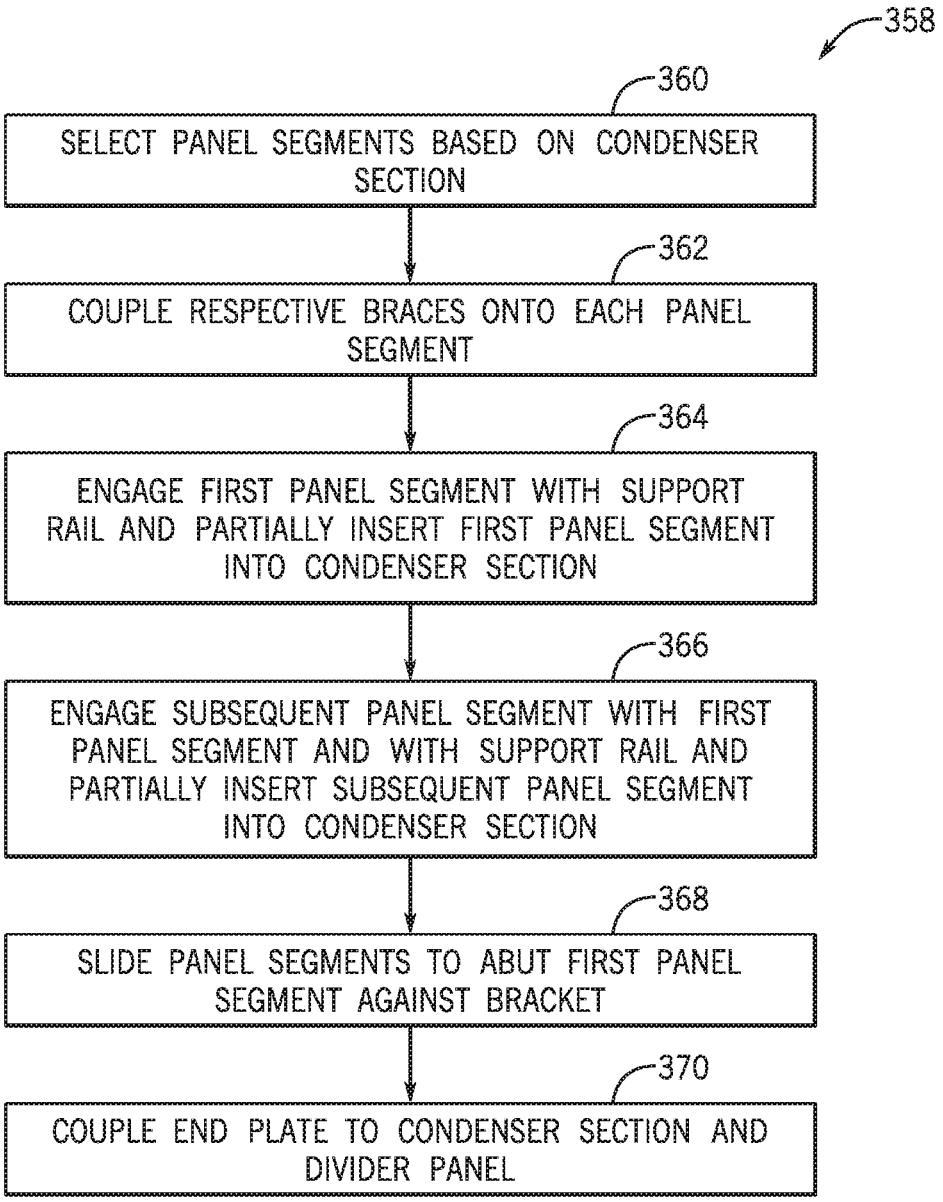

FIG. 12 is a side view of an embodiment of a divider panel assembly in an installed configuration within a condenser section of an HVAC system, in accordance with an aspect of the present disclosure; and FIG. 13 is a block diagram of an embodiment of a method or process for installing a divider panel assembly in a condenser section of an HVAC system, in accordance with an aspect of the present disclosure.

DETAILED DESCRIPTION

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

The present disclosure is directed to an HVAC system having a condenser section configured to cool a refrigerant flowing through the HVAC system. The condenser section may include multiple fans configured to force or draw air across a coil through which the refrigerant flows, thereby cooling the refrigerant flowing through the coil. In some embodiments, each of the fans may be independently controllable, such that the speed of each fan may vary relative to one another and/or the operation of certain fans may be suspended while a remainder of the fans continue to operate. For example, the HVAC system may include multiple refrigeration circuits, each having a respective coil in the condenser section through which refrigerant may independently flow. In a reheat mode or a low ambient mode of operation, in which less cooling of the refrigerant may be desirable, the refrigerant may not flow through certain coils within the condenser section. As a result, a first set of fans configured to direct air across coils that are not in use may be inactive while a second set of fans configured to direct air across coils that are in use may be active and may continue to cool the refrigerant in the condenser section.

However, suspending operation of the first set of fans may affect an operation of the second set of fans. For example, each fan of the first and second sets of fans may be fluidly connected to a single volume of the condenser section, through which air may be drawn by each fan. As the second set of fans continues to draw in air through the shared volume of the condenser section, air within the shared volume may flow across the first set of fans, even though the first set of fans are not in operation to draw in air flow. As a result, the air drawn into the shared volume by the second set of fans may flow through the first set of fans instead of flowing across the second set of fans. In this way, an amount of air flowing across the coils as directed by the second set of fans may be reduced, thereby reducing an efficiency of the second fans to cool the refrigerant and reducing the efficiency of the HVAC system to condition supply air. In some instances, a backflow of air may be generated across the first set of fans while the second set of fans is in operation, further reducing efficiency of the HVAC system.

Thus, it is presently recognized that utilizing a partition within the condenser section may divide the volume of the condenser section to enable each set of fans to force or draw air across the coils efficiently. Accordingly, embodiments of the present disclosure are directed to an insertable divider panel or divider panel assembly configured to be positioned in the condenser section to divide the condenser section into a first volume fluidly connected with the first set of fans and a second volume fluidly connected with the second set of fans. The divider panel assembly may block air from flowing between the first volume and the second volume. As such, if the first set of fans is inactive, substantially all of the air drawn into the second volume by the second set of fans may be directed across the coil in the second volume to cool the refrigerant in the coil of the second volume, thereby maintaining the efficiency of the second set of fans to direct air and cool the refrigerant. In some embodiments, the divider panel assembly may include a plurality of panels to improve assembly and/or transportation of the divider panel assembly. The panels are configured to couple with one another, and the panels utilized may be selected based on a geometry of the condenser section. As such, a particular combination of panels may be implemented based on the specific condenser section in order to effectively reduce an energy consumption of the HVAC system.

Furthermore, the divider panel assembly may be readily implemented into an existing HVAC system. As an example, the divider panel assembly may be inserted into an existing condenser section without having to disassemble multiple parts of the condenser section. For this reason, the divider panel assembly may be easily installed onto an existing HVAC system so as to enable additional functionality of the HVAC system to suspend operation of a subset of fans without reducing an efficiency of a remainder of the fans in operation. Further still, the divider panel assembly may be easily removeable from the condenser section. For instance, the divider panel assembly may be removed to reduce a weight of the HVAC system and/or a number of components of the HVAC system, as desired. In this manner, the divider panel assembly may facilitate improved manufacture and/or modification of the HVAC system. In some embodiments, each panel of the divider panel assembly may be individually and sequentially inserted into and/or removed from the condenser section. For this reason, there does not have to be a substantial amount of space to enable maneuvering of the divider panel assembly to modify the HVAC system, as enough room to accommodate the size of an individual divider panel assembly, rather than the size of the entire divider panel assembly, may be sufficient to enable installation and/or removal of the divider panel assembly.

Figure 1:
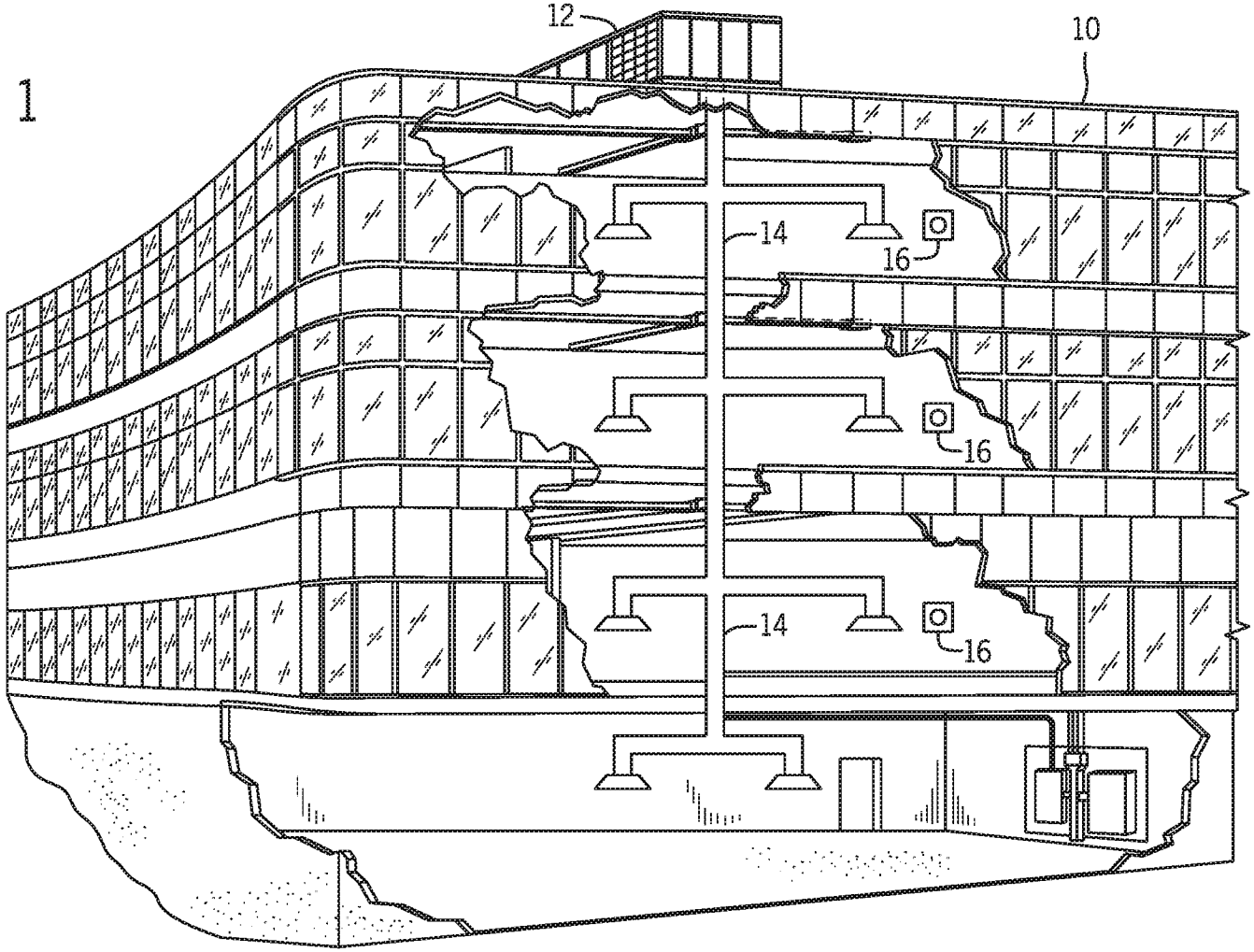
FIG. 1 is a perspective view of an embodiment of a heating, ventilation, and/or air conditioning (HVAC) system for environmental management that may employ one or more HVAC units, in accordance with an aspect of the present disclosure.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
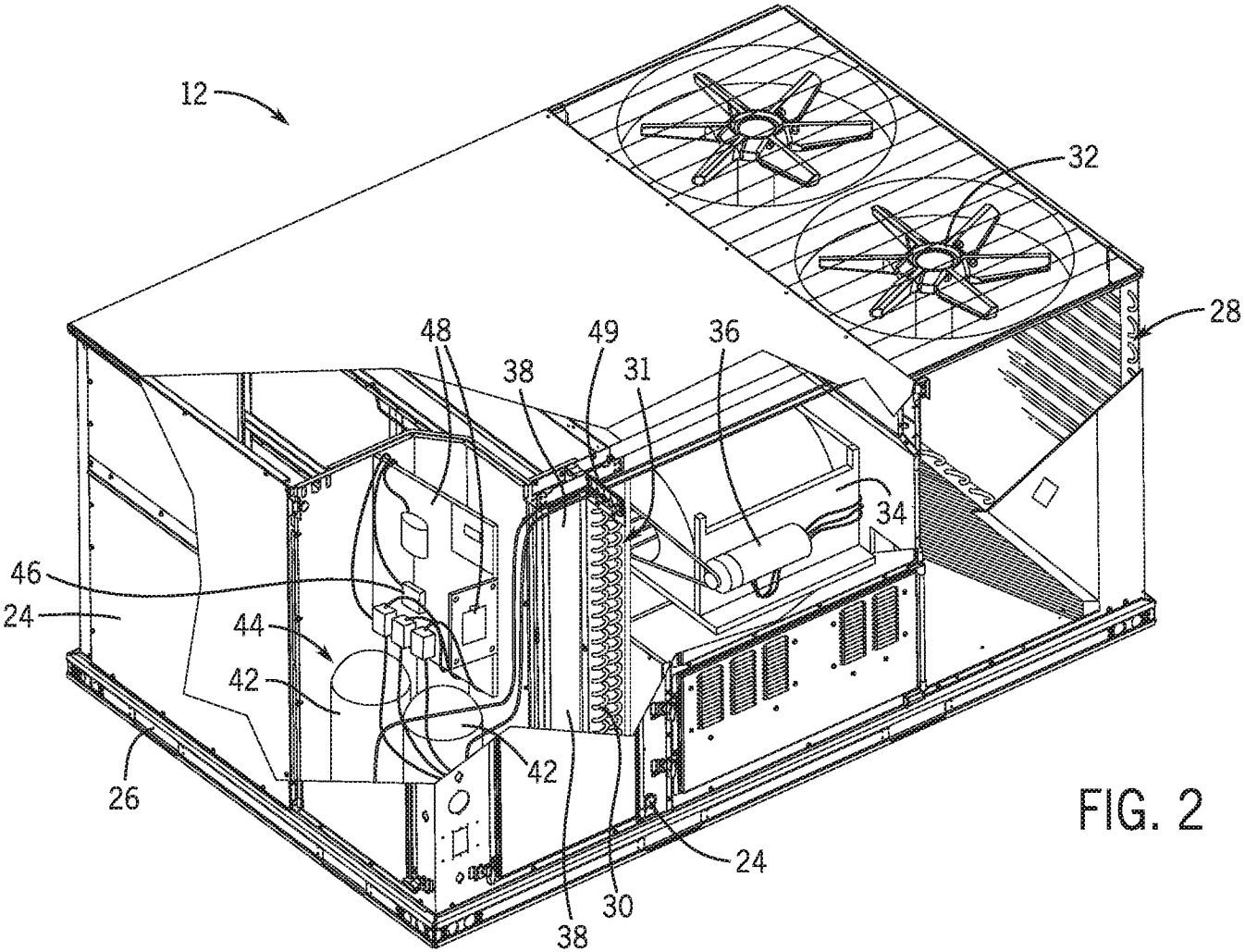
FIG. 2 is a perspective view of an embodiment of a packaged HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. Additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
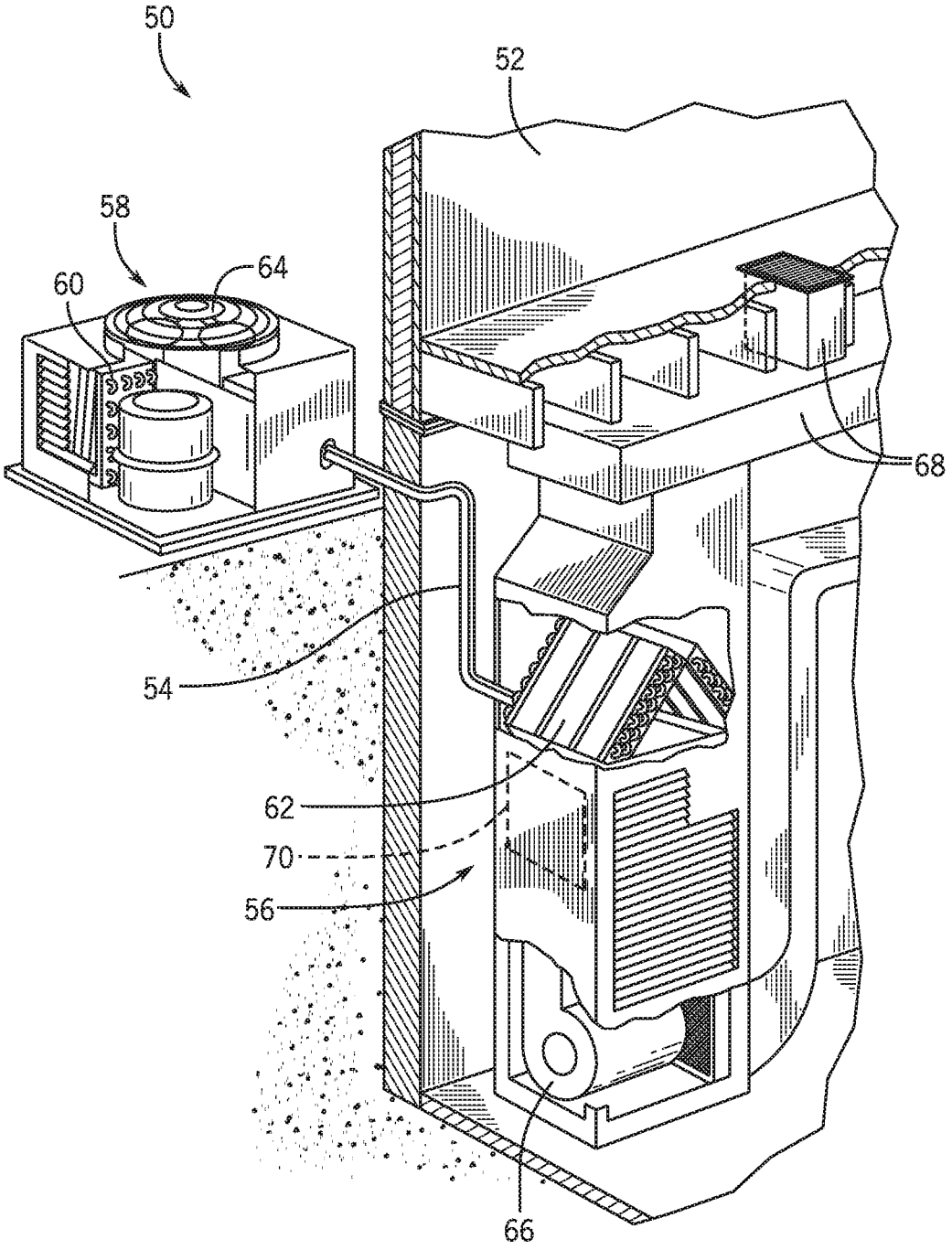
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
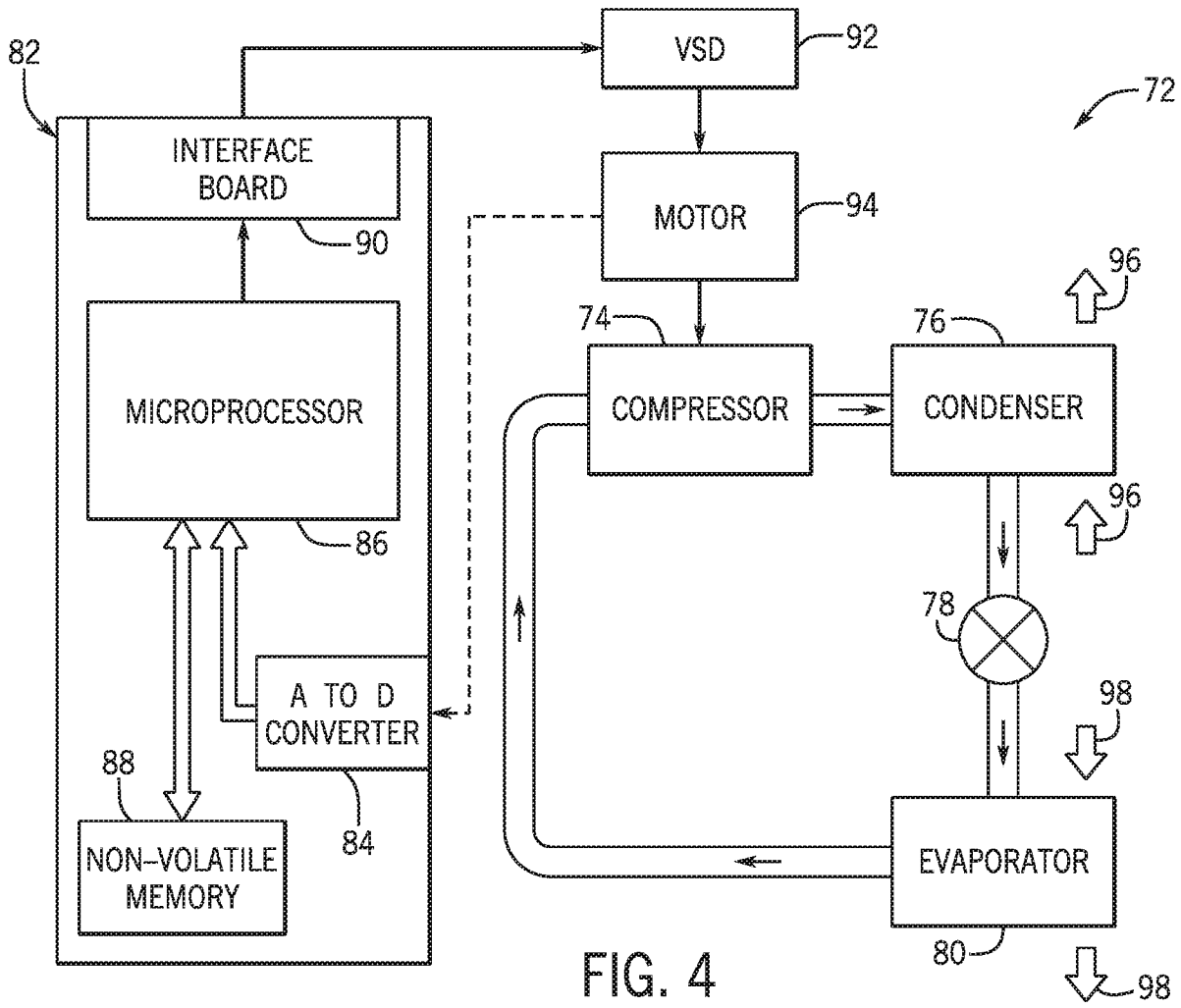
FIG. 4 is a schematic of an embodiment of a vapor compression system that can be used in any of the systems of FIGS. 1-3, in accordance with an aspect of the present disclosure, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

Any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

The present disclosure is directed to a divider panel assembly that is readily insertable into a condenser section of an HVAC system to divide the condenser section into separate volumes. The divider panel assembly may include several panels that are selectable based on a geometry of the condenser section to enable the divider panel assembly to block air from flowing between separated volumes of the condenser section. Implementation of the divider panel assembly may enable fans of the condenser section to maintain an efficiency to direct air across coils of the condenser section, thereby cooling the refrigerant efficiently. Furthermore, the divider panel assembly may be easily installed into and removed from the condenser section. For example, each panel may be configured to insert into the condenser section without having to modify, such as disassemble, other components of the condenser section. Thus, the divider panel assembly may be installed into the condenser section after the HVAC system has been manufactured, and the divider panel assembly does not have to be integrated into the condenser section during manufacture of the HVAC system. As such, a complexity of the manufacture of the HVAC system may be reduced. The divider panel assembly may also be easily removed from the condenser section without having to modify other components of the condenser section. Thus, the condenser section may be easily adjustable. It should be understood that, although the present disclosure primarily discusses implementation of the divider panel assembly in a condenser section of the HVAC system, the divider panel assembly may be implemented in any suitable part of the HVAC system, such as an evaporator section, an air duct, and so forth, to divide a section of the HVAC system into separate volumes.

Figure 5:
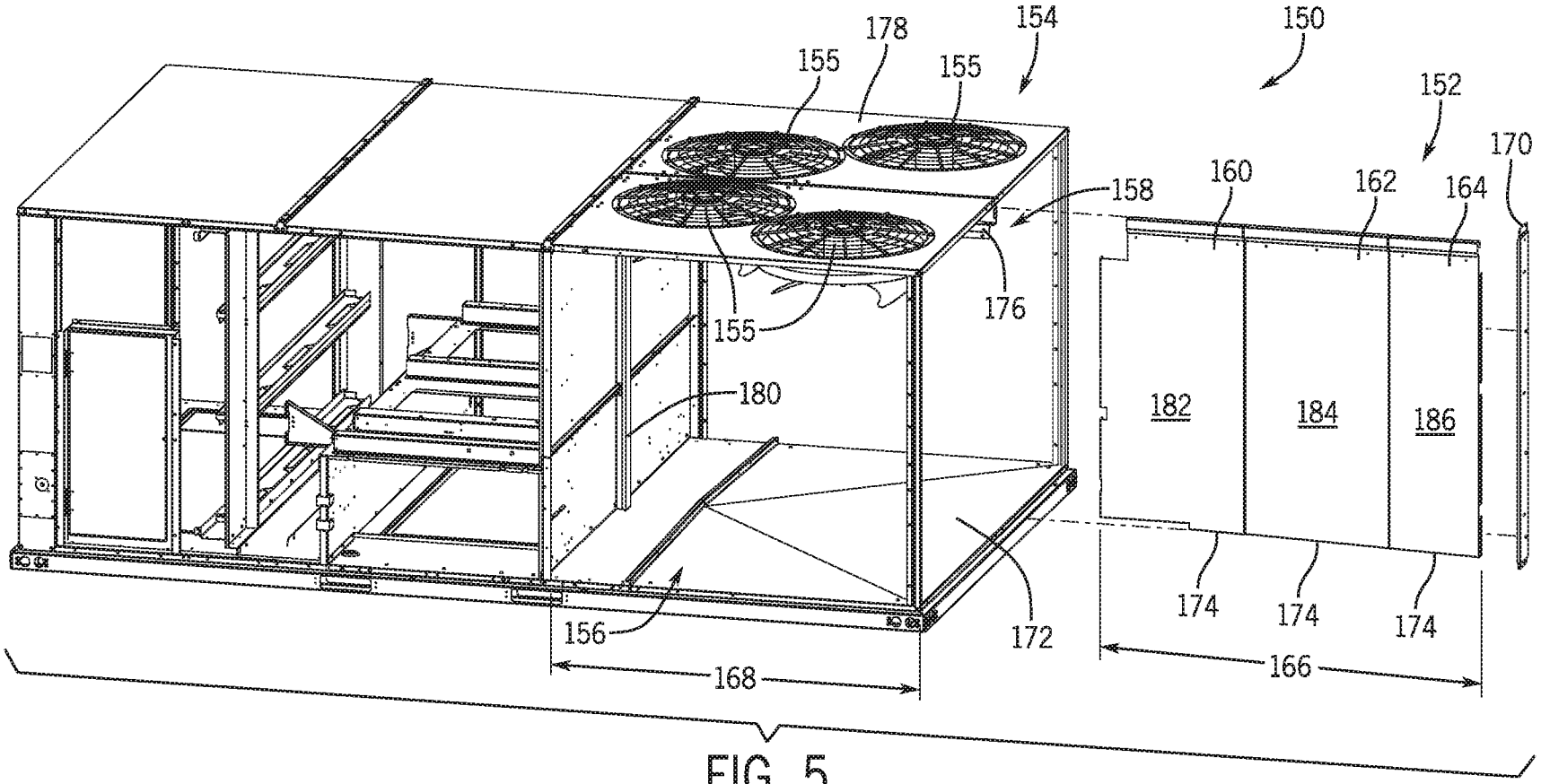
FIG. 5 is a perspective view of an embodiment of an HVAC system configured to utilize a divider panel assembly in a condenser section of the HVAC system, in accordance with an aspect of the present disclosure.

FIG. 5 is a perspective view of an embodiment of an HVAC system 150 configured to utilize a divider panel assembly 152 in a condenser section 154 of the HVAC system 150. In the illustrated embodiment, the HVAC system 150 is a rooftop unit, but it should be noted that the features described herein may be used in any suitable condenser section 154. Furthermore, certain components of the HVAC system 150, such as condenser coils and condenser walls, are not shown for reasons of clarity. The condenser section 154 may include a plurality of fans 155 that are independently controllable. For example, a subset of the plurality of fans 155 may not be in operation, or may be inactive, in a particular mode, such as a reheat mode, of the HVAC system 150. However, the inactive fans 155 may reduce an efficiency of the fans 155 that are actively operating, such as by reducing an amount of air flowing across the fans 155 in operation and/or by enabling a backflow of air across the inactive fans 155. Thus, the divider panel assembly 152 may be included in the condenser section 154 to separate a first volume 156 of the condenser section 154 from a second volume 158 of the condenser section 154. When the divider panel assembly 152 is inserted within the condenser section 154, suspending operation of the fans 155 associated with the first volume 156 may not affect the operation of the fans 155 associated with the second volume 158, and vice versa. Thus, the efficiency of the active fans 155 is maintained. Furthermore, the divider panel assembly 152 may be readily removable from the condenser section 154. For example, to reduce a number of parts and/or a weight of the HVAC system 150, such as during transportation of the HVAC system 150, the divider panel assembly 152 may be removed.

In some embodiments, the divider panel assembly 152 may be an assembly of a first or inner panel 160, a second or intermediate panel 162, and a third or outer panel 164 that are each configured to couple with one another. As an example, the combination of panels 160, 162, 164 may be selected such that a first length 166 of the divider panel assembly 152 substantially matches a second length 168 of the condenser section 154. In this way, the divider panel assembly 152 substantially separates the first volume 156 from the second volume 158 in order to block air flow between the first volume 156 and the second volume 158 across the second length 168. In other HVAC systems 150 having condenser sections 154 of different sizes, other embodiments of panels may be selected such that the first length 166 of the divider panel assembly 152 substantially matches with the second length 168 of the corresponding condenser section 154. For example, the divider panel assembly 152 may include any suitable number of panels, including more than three panels, fewer than three panels, panels of different lengths than depicted in FIG. 5, and the like. Furthermore, an end cap 170 may be configured to abut the third panel 164. The end cap 170 may also engage with walls of the condenser section 154, and the end cap 170 and the walls may cooperatively seal the condenser section 154 to block air from flowing out of the condenser section 154 except via the fans 155. The end cap 170 is configured to couple to a third flange 200C of the third panel 164 via mechanical fasteners 208. As an example, holes 210 of the end cap 170 may be configured to align with respective holes 212 of the third flange 200C. The mechanical fasteners 208 may insert through the holes 210 and the holes 212 to couple the end cap 170 to the third flange 200C. In additional or alternative embodiments, the end cap 170 may be coupled to the third flange 200C in any other suitable manner, such as a snap-fit connection, an interference fit connection, welding, adhesives, or any combination thereof, as described above.

The divider panel assembly 152 may engage with a base panel 172 of the condenser section 154 in an installed configuration of the divider panel assembly 152. For example, respective base surfaces 174 of the panels 160, 162, 164 may abut with the base panel 172. The abutment between the base surfaces 174 and the base panel 172 may block air from flowing between the base panel 172 and the panels 160, 162, 164 and therefore between the first volume 156 and second volume 158. Additionally, as will be further discussed below, the divider panel assembly 152 may be secured within the condenser section 154 via a support rail 176 coupled to a fan deck 178 of the condenser section 154. The support rail 176 may block air from flowing between the divider panel assembly 152 and the fan deck 178 to further block air flow between the first volume 156 and the second volume 158. In some embodiments, the condenser section 154 may also include a bracket 180 with which the first panel 160 may engage to maintain a position of the divider panel assembly 152 in the condenser section 154. The bracket 180 and the support rail 176 may cooperatively maintain the position of the divider panel assembly 152 within the condenser section 154 to enable the divider panel assembly 152 to block air from flowing between the first volume 156 and the second volume 158.

In the illustrated embodiment, each of the panels 160, 162, 164 includes a generally rectangular shape, and the panels 160, 162, 164 may be coupled to one another along a common plane. That is, a first plane 182 of the first panel 160 may be substantially aligned with a second plane 184 of the second panel 162 and a third plane 186 of the third panel 164 in the installed configuration of the divider panel assembly 152. In additional or alternative embodiments, the panels 160, 162, 164 may have different shapes than shown in FIG. 5 and/or each of the panels 160, 162, 164 may be aligned in a different manner, such as with the planes 182, 184, 186 offset from one another.

Figure 6:
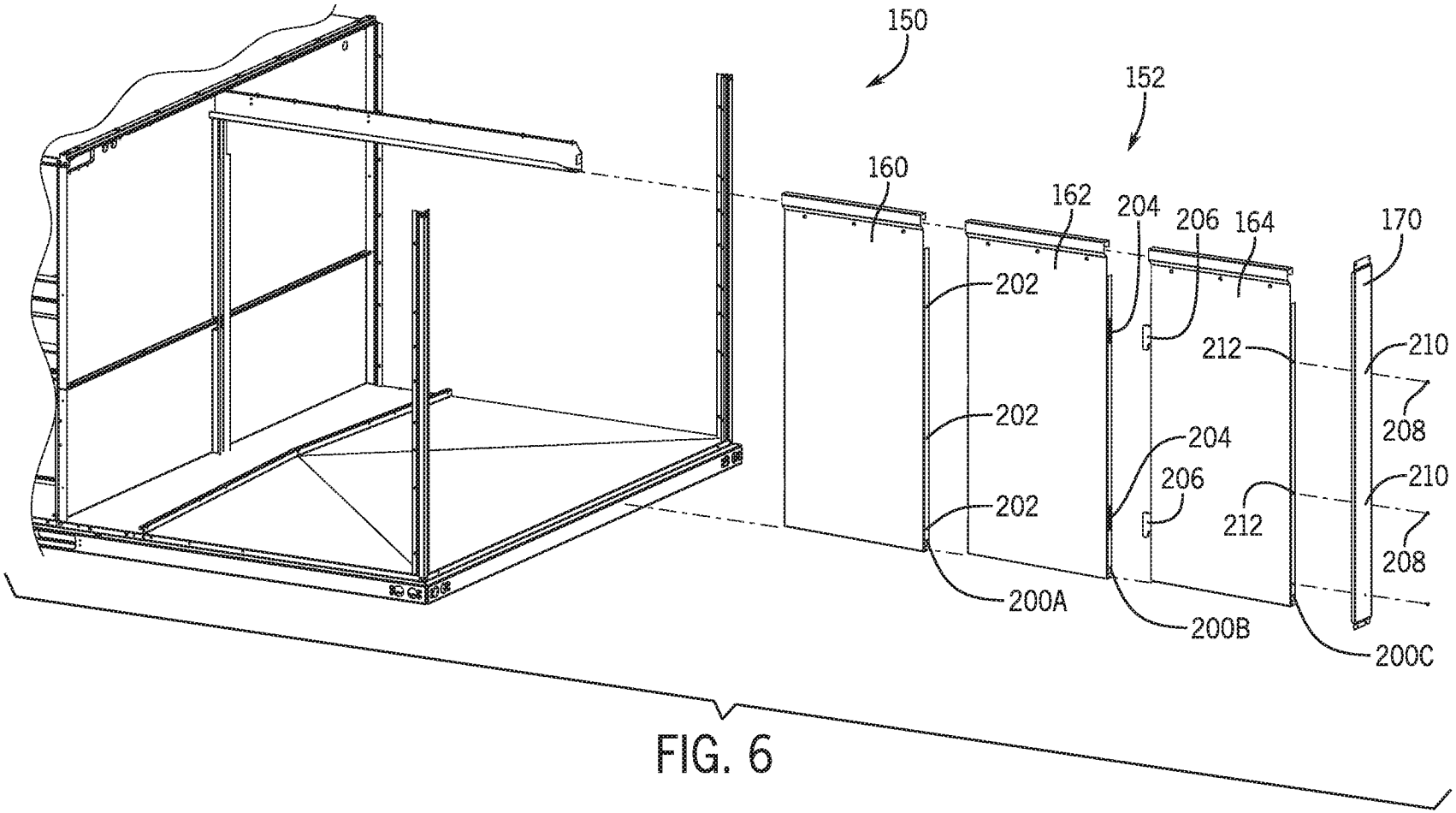
FIG. 6 is an exploded view perspective of an embodiment of a divider panel assembly that may be employed by the HVAC system, in accordance with an aspect of the present disclosure.

FIG. 6 is an exploded perspective view of an embodiment of the divider panel assembly 152 that may be employed by the HVAC system 150. Each of the panels 160, 162, 164 includes flanges 200. The respective flanges 200 of the panels 160, 162, 164 may be configured to abut one another to couple the panels 160, 162, 164 with one another. In the illustrated embodiment, the first panel 160 includes a first flange 200A having holes 202 that are each configured to receive a mechanical fastener, such as a screw, to secure the first panel 160 to the second panel 162. Further, the second panel 162 includes a second flange 200B having slots 204, and the third panel 164 includes protrusions 206 configured to insert into the respective slots 204. For example, each protrusion 206 may be secured within a corresponding slot 204 via a snap-fit connection. In additional or alternative embodiments, the panels 160, 162, 164 may be coupled to one another in any other suitable manner, such as an interference fit connection, welding, adhesives, or any combination thereof.

Figure 7:
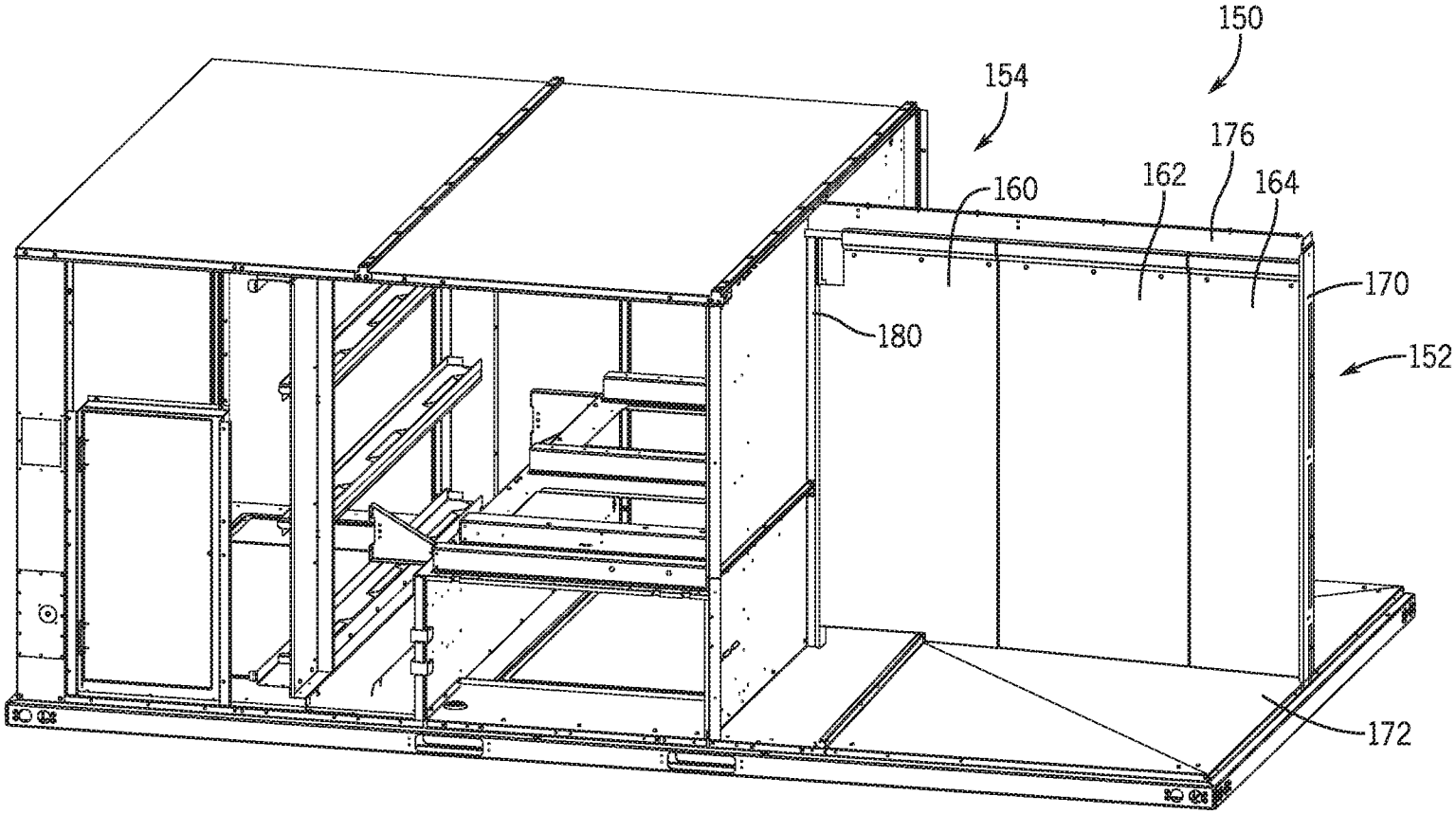
FIG. 7 is a perspective view of an embodiment of an HVAC system having a divider panel assembly in an installed configuration within a condenser section of the HVAC system, in accordance with an aspect of the present disclosure.

FIG. 7 is a perspective view of an embodiment of the HVAC system 150 illustrating the divider panel assembly 152 in the installed configuration within the condenser section 154. In the installed configuration, each of the panels 160, 162, 164 may engage with the support rail 176. By way of example, the support rail 176 may capture a portion of each of the panels 160, 162, 164 to block movement of the divider panel assembly 152. Furthermore, the innermost panel, or first panel 160 in the illustrated embodiment, may engage with the bracket 180. In an example, the first panel 160 may insert into a recess of the bracket 180, such that the recess of the bracket 180 restricts movement of the first panel 160 within the condenser section 154 as well as remaining panels of the divider panel assembly 152 within the condenser section 154. The end cap 170 may also be coupled to the outermost panel in the installed configuration of the divider panel assembly 152. In the illustrated embodiment, the end cap 170 is configured to couple to the third panel 164. In certain embodiments, the end cap 170 may also be coupled to the base panel 172 of the condenser section 154. In this way, the end cap 170 restricts movement of the third panel 164 relative to the base panel 172, thereby further restricting movement of the divider panel assembly 152 within the condenser section 154.

Figure 8:
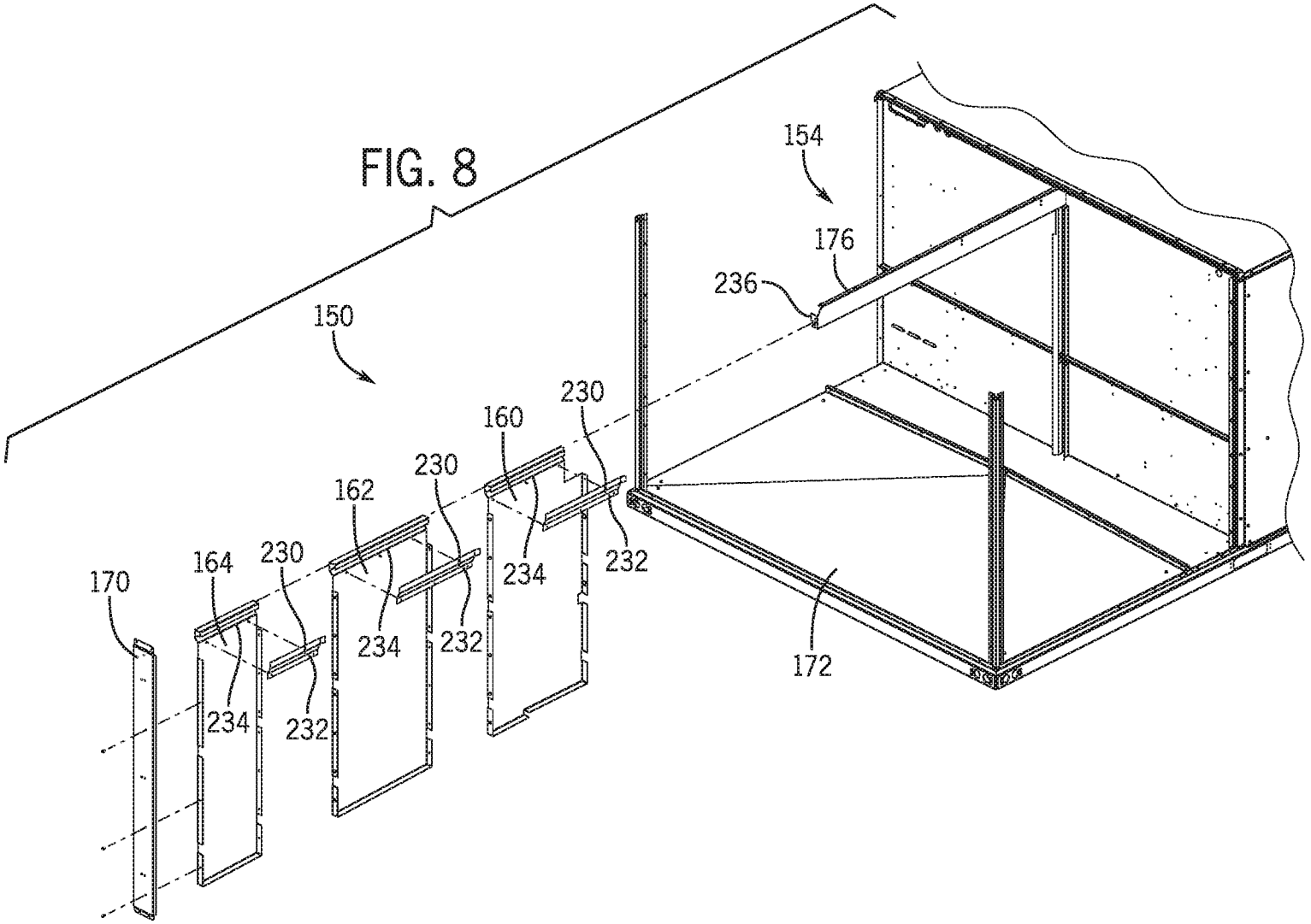
FIG. 8 is an exploded perspective view of an embodiment of a divider panel assembly to be installed in an HVAC system, in accordance with an aspect of the present disclosure.

FIG. 8 is an exploded perspective view of an embodiment of the divider panel assembly 152 to be installed in the HVAC system 150. As shown in FIG. 8, each of the panels 160, 162, 164 may be configured to couple to a respective brace 230. Each brace 230 may further secure the panels 160, 162, 164 onto the support rail 176 and restrict movement of the divider panel assembly 152 relative to the support rail 176. In the illustrated embodiment, holes 232 of the braces 230 may align with respective holes 234 of the panels 160, 162, 164, and a fastener may be inserted through each hole 232 and corresponding hole 234 to couple the braces 230 with the panels 160, 162, 164. However, the braces 230 and the panels 160, 162, 164 may be coupled to one another in any suitable manner.

The support rail 176 may include a flange 236 configured to abut the end plate 170 in the installed configuration of the divider panel assembly 152. As such, the flange 236 may be configured to couple to the end plate 170, such that the end plate 170 is coupled to the support rail 176, the third panel 164, and the base panel 172 of the condenser section 154. In this manner, movement of the support rail 176, the divider panel assembly 152, and the condenser section 154 is restricted.

Figure 9:
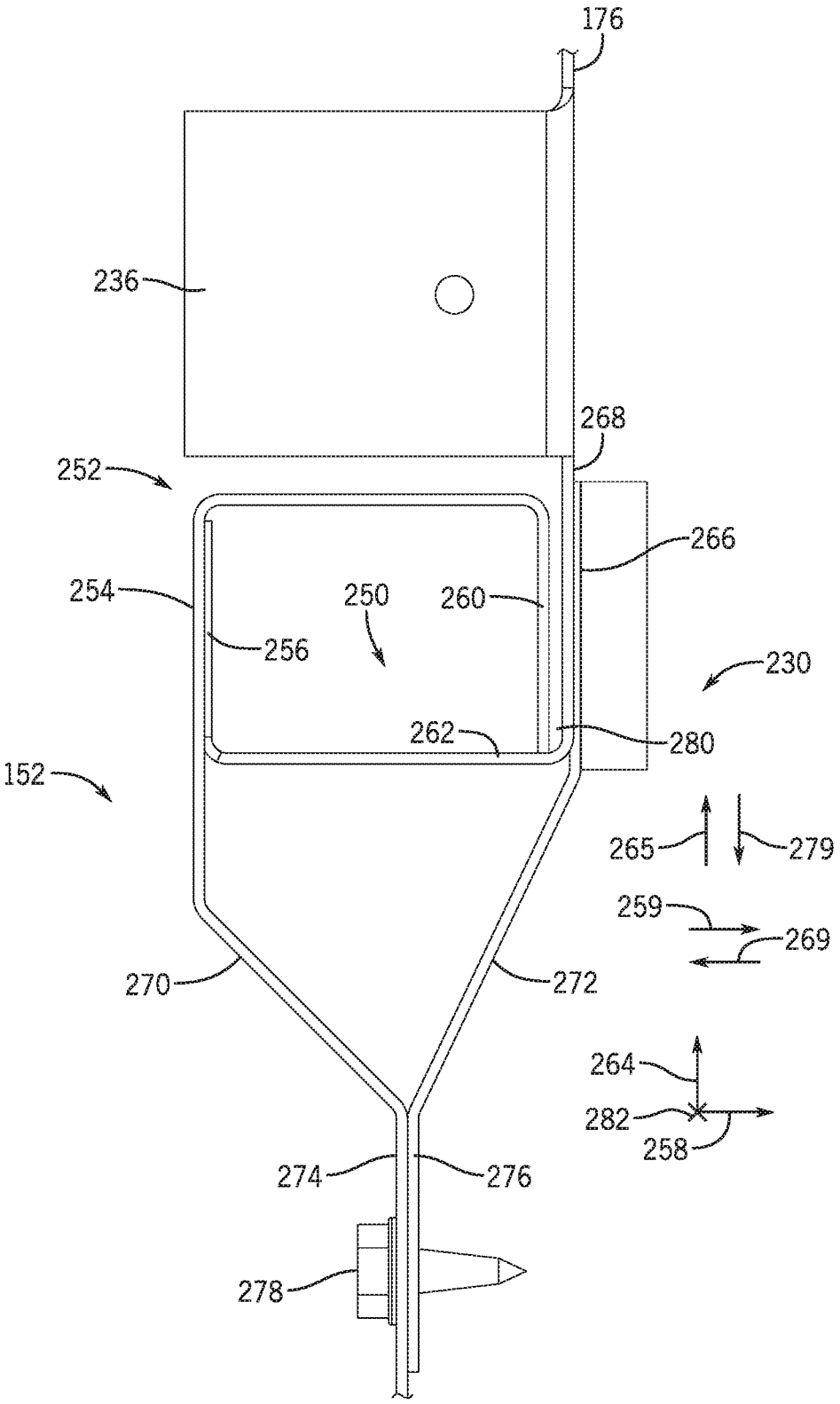
FIG. 9 is an expanded side view of an embodiment of a divider panel assembly in an installed configuration within a condenser section of an HVAC system, in accordance with an aspect of the present disclosure.

FIG. 9 is an expanded side view of an embodiment of the divider panel assembly 152 in the installed configuration. In particular, FIG. 9 illustrates the interface between the support rail 176 with one of the panels 160, 162, 164 and a corresponding brace 230. In the illustrated embodiment, the support rail 176 is hook or J-shaped to form a channel 250 configured to engage with a corresponding hook portion 252 of the panels 160, 162, 164. For example, the hook portion 252 may be positioned such that a first segment or portion 254 of the hook portion 252 abuts against a second segment or portion 256 of the channel 250, thereby restricting movement of the hook portion 252 along a lateral axis 258, such as in a first lateral direction 259. Additionally, a third segment or portion 260 of the hook portion 252 is configured to abut a fourth segment or portion 262 of the channel 250, thereby restricting movement of the hook portion 252 along a vertical axis 264, such as in a first vertical direction 265.

A fifth segment or portion 266 of the brace 230 may be configured to abut a sixth segment or portion 268 of the channel 250 to block movement of the brace 230 along a second lateral direction 269. In the installed configuration, a seventh segment or portion 270 of the hook portion 252 is configured to extend toward an eighth segment or portion 272 of the brace 230, such that the hook portion 252 and the brace 230 cooperatively form a V-shape. Furthermore, a body section 274 of the panel 160, 162, 164 extending from the seventh segment 270 of the hook portion 252 may be configured to couple to a ninth segment or portion 276 of the brace 230, such as via a mechanical fastener 278 extending through the body section 274 and the ninth segment 276 to couple the panel 160, 162, 164 to the brace 230. Thus, the interface between the body section 274 of the panel 160, 162, 164 and the ninth segment 276 of the brace 230 may restrict movement between the panel 160, 162, 164 and the brace 230. The ninth segment 276 of the brace 230 may be substantially parallel to the fifth segment 266 of the brace 230 and offset from the fifth segment 266 along the lateral axis 258. As such, the eighth segment 272 of the brace 230 may form an angle, such as an angle between 30 degrees and 60 degrees, relative to the fifth segment 266 and to the ninth segment 276. The hook portion 252, the fifth segment 266 of the brace 230, and the eighth segment 272 of the brace 230 may cooperatively capture the channel 250 to block the movement of the panel 160, 162, 164 in a second vertical direction 279. Therefore, the brace 230 further restricts movement between the panel 160, 162, 164 and the support rail 176 to secure the panel 160, 162, 164 within the condenser section 154, such as along a longitudinal axis 282.

In some embodiments, the subassembly of each panel 160, 162, 164 and corresponding brace 230 may be configured to couple to the support rail 176 by inserting the respective hook portions 252 into the channel 250. To this end, there may be a space or gap 280 between the third segment 260 of the hook portion 252 and the fifth segment 266 of the brace 230 to facilitate insertion of the hook portions 252 into the channel 250 such that the sixth segment 268 of the channel 250 extends into the space 280. In addition, the flange 236 of the support rail 176 is offset from the hook portion 252 along the vertical axis 164. Thus, the flange 236 does not block the insertion of the hook portion 252 into the channel 250.

Figure 10:
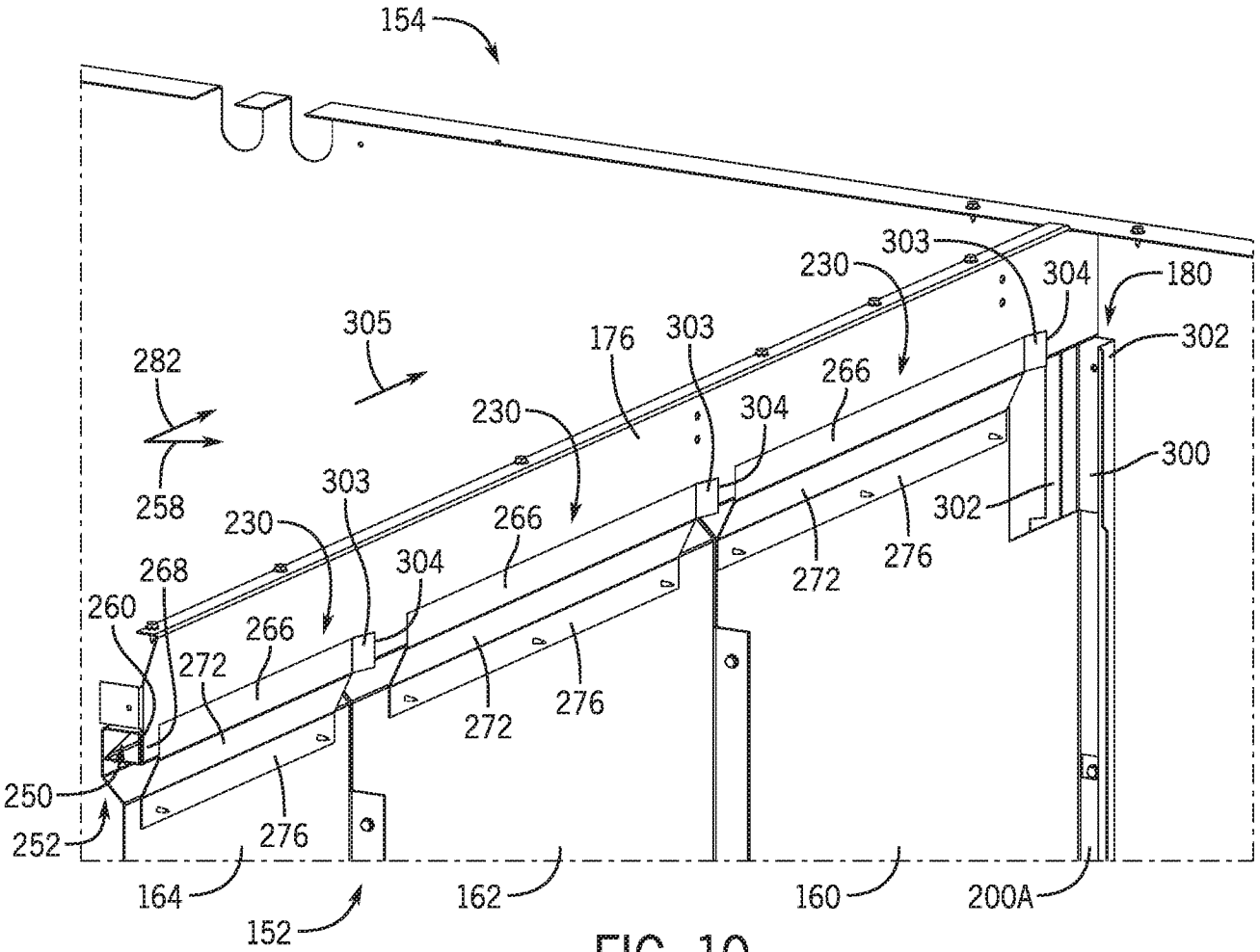
FIG. 10 is a perspective view of an embodiment of a divider panel assembly in an installed configuration within a condenser section of an HVAC system, in accordance with an aspect of the present disclosure.

FIG. 10 is a perspective view of an embodiment of the divider panel assembly 152 in the installed configuration within the condenser section 154. In the installed configuration, one of the first flanges 200A of the first panel 160 may be positioned within a recess 300 of the bracket 180 formed between bracket flanges 302 of the bracket 180. The first flange 200A may abut against the bracket 180 to secure the first panel 160 with the bracket 180, and the bracket flanges 302 may capture the first flange 200A within the recess 300 to restrict movement of the divider panel assembly 152 within the bracket 180. In some embodiments, the bracket flanges 302 may be flared outward, such as at an angle from the longitudinal axis 282, to facilitate insertion of the first flange 200A into the recess 300. That is, the geometry of the bracket flanges 302 may guide the first flange 200A into the recess 300 to abut the bracket 180.

Additionally, as shown in FIG. 10, each brace 230 includes a brace flange 303 extending from the fifth segment 266 of the respective brace 230. Each brace flange 303 may also include a distal flange end 304 angled outward along the lateral axis 258 from the fifth segment 266, the eighth segment 272, and/or the ninth segment 276, which may collectively form a main body of the brace 230. As such, when the divider panel assembly 152 is inserted through the channel 250 along a longitudinal direction 305, the brace flanges 303 may guide the sixth segment 268 of the channel 250 within the space 180 between the fifth segment 266 of the brace 230 and the third segment 260 of the hook portion 252 of the panels 160, 162, 164. Thus, the brace flanges 303 facilitate installation of the divider panel assembly 152 along the support rail 176.

Figure 11:
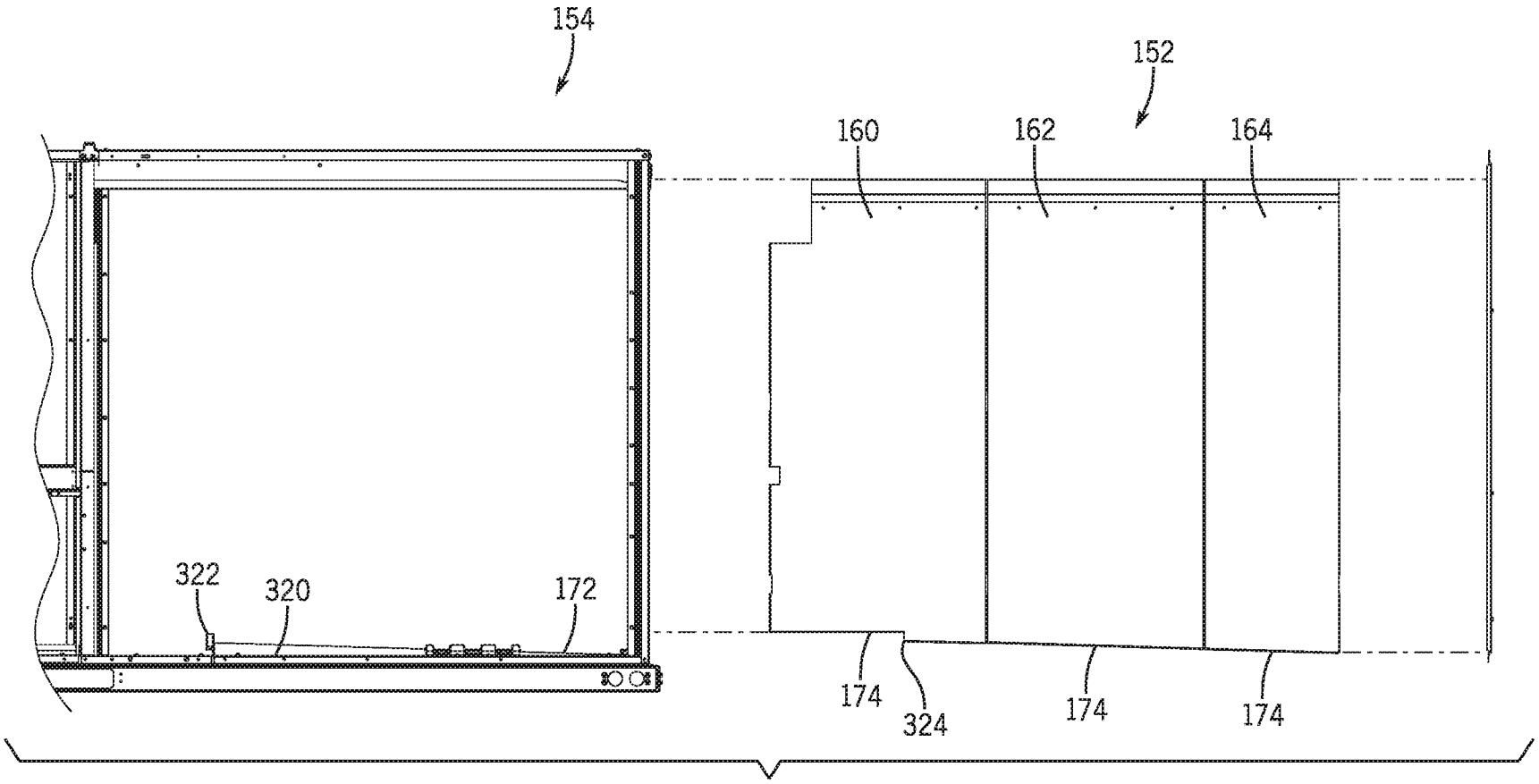
FIG. 11 is a side view of an embodiment of a divider panel assembly and a condenser section of an HVAC system, in accordance with an aspect of the present disclosure.

FIG. 11 is a side view of an embodiment of the condenser section 154 and the divider panel assembly 152. In the illustrated embodiment, the base panel 172 includes a sloped portion 320 configured to guide condensate out of the condenser section 154 along the base panel 172. The shape of the respective base surfaces 174 of the panels 160, 162, 164 may match with a shape of the sloped portion 320. For example, the base surfaces 174 may be angled to mate the sloped portion 320. Furthermore, the sloped portion 320 may include a base flange 322. For this reason, the base surface 174 of the first panel 160 may include a lip 324 configured to abut the base flange 322. In this manner, the base surfaces 174 are shaped to enable the divider panel assembly 152 to match the profile of the base panel 172, thereby facilitating engagement between the divider panel assembly 152 and the base panel 172 in order to block air from flowing between the divider panel assembly 152 and the base panel 172. Although the base panel 172 includes a sloped profile and the base surfaces 174 are angled in the illustrated embodiment, the base panel 172 may include any suitably shaped profile, and the shape of the base surfaces 174 may be formed so as to match with the shape of the base panel 172. Thus, the base surfaces 174 may effectively conform to the shape of the base panel 172 to block air from flowing between the base surfaces 174 and the base panel 172.

FIG. 12 is a side view of an embodiment of the divider panel assembly 152 in the installed configuration within the condenser section 154. The base panel 172 of the illustrated condenser section 154 includes a projection 340 of which the divider panel assembly 152 may capture and/or otherwise engage. For instance, the base surface 174 of the divider panel assembly 152 may have an h-shape to form a channel 342 that may receive the projection 340. The shape of the channel 342 may substantially match the shape of the projection 340. Thus, even though the illustrated channel 342 has a rectangular shape, additional or alternative channels 342 may have a triangular shape, arcuate shape, or any suitable shape, and the base surface 174 of the divider panel assembly 152 may have a similar shape to capture the channel 342. By capturing the channel 342, the projection 340 may limit the movement of the base surface 174 relative to the base panel 172. As a result, overall movement of the divider panel assembly 152 within the condenser section 154 is reduced, thereby enabling the divider panel assembly 152 to block air flow between the first volume 156 and the second volume 158.

FIG. 13 is a block diagram of an embodiment of a method or process 358 for installing the divider panel assembly 152 in the condenser section 154. By way of example, the method 358 may be performed by a manufacturer during the manufacture of the HVAC system 150, and/or the method 358 may be performed by a technician or operator after the HVAC system 150 has already been manufactured. It should be noted that the steps of the method 358 may be performed differently than depicted in FIG. 13, such as for different embodiments of the divider panel assembly 152 and/or the condenser section 154. For example, additional steps may be performed with respect to the method 358, and/or certain steps of the illustrated method 358 may be removed, modified, and/or performed in a different order.

At block 360, panels may be selected or manufactured based on the condenser section 154. For instance, the combination of panels may be selected based on the second length 168 of the condenser section 154. Additionally or alternatively, the panels may be selected to match the geometry of the base surfaces 174 with a profile of the base panel 172. In any case, the panels are selected to produce a particular divider panel assembly 152 that effectively blocks air flow between the first volume 156 and the second volume 158 of the condenser section 154.

At block 362, the braces 230 are coupled to the respective panels. In some implementations, the braces 230 may be mechanically fastened to corresponding panels. In additional or alternative implementations, the braces 230 may be welded to the panels and/or secured to the panels via adhesives. As a result of coupling the braces 230 to the panels, a brace and panel subassembly is created.

At block 364, the first panel 160 is engaged with the support rail 176 and partially inserted into the condenser section 154. As an example, the hook portion 252 of the first panel 160 is engaged with the channel 250 of the support rail 176, and the brace 230 is abutted with the support rail 176. Additionally or alternatively, the base surface 174 is abutted with the base panel 172. Thus, lateral movement of the first panel 160 is substantially restricted within the condenser section 154. The first panel 160 may then be positioned, such as via sliding, along the base panel 172 and the support rail 176 until a majority of the hook portion 252 is disposed within the condenser section 154. In this position, one of the first flanges 200A of the first panel 176 may remain extended out of the condenser section 154.

At block 366, another panel, such as the second panel 162 is engaged with the first panel 160. By way of example, one of the second flanges 200B of the second panels 162 may couple to the first flange 200A that extends out of the condenser section 154. In some embodiments, the first flange 200A and the second flange 200B may be coupled with one another via mechanical fasteners. In additional or alternative embodiments, the first flange 200A and the second flange 200B may be coupled with one another via snap-fit connections, interference connections, welds, adhesives, or any combination thereof. Once the second panel 162 is coupled to the first panel 160 and to the support rail 176, the first panel 160 and the second panel 162 may be inserted further into the condenser section 154 along the support rail 176 and the base panel 172. Further movement of the first panel 160 and the second panel 162 may cause the hook portion 252 of the second panel 162 to engage the channel 250 and the base surface 174 of the second panel 162 to engage the base panel 172. Thus, the second panel 162 is secured within the condenser section 154. It should be noted that if additional panels are to be coupled to the second panel 162, the second panel 162 may be moved to a position in which one of the second flanges 200B of the second panel 162 remains extended out of the condenser section 154. Thus, the step described at block 366 may be repeated for each subsequent panel to be installed into the condenser section 154 as part of the divider panel assembly 152 to insert each panel sequentially into the condenser section 154. In some implementations, the order of panels to be installed into the condenser section 154 may be labeled on the respective body sections 274 of the panels to facilitate accurate assembly of the divider panel assembly 152.

After all panels have been connected to one another to assemble the divider panel assembly 152, the divider panel assembly 152 may be positioned within the condenser section 154 such that the first panel 160 abuts against the bracket 180, as indicated at block 368. In this position, the bracket 180 may restrict movement of the first panel 160 relative to the bracket 180, thereby securing the divider panel assembly 152 within the condenser section 154. Furthermore, the entire divider panel assembly 152 may be inserted within the condenser section 154 to be in the installed configuration.

Once the divider panel assembly 152 is in the installed configuration within the condenser section 154, the end plate 170 may be coupled to the condenser section 154. The end plate 170 may be coupled to the outermost panel of the divider panel assembly 152, thereby blocking air from flowing between the divider panel assembly 152 and the end plate 170. Moreover, the end plate 170 may be coupled to the base panel 172 and/or to walls of the condenser section 154, thereby restricting movement of the end plate 170 relative to the condenser section 154. The coupling between the divider panel assembly 152, the condenser section 154, and the end plate 170 may further secure the position of the divider panel assembly 152 within the condenser section 154.

In some embodiments, another method that is opposite the method 358 may be used to remove the divider panel assembly 152 from the condenser section 154. That is, the end plate 170 may be decoupled from the condenser section 152 and each panel may be individually and sequentially slid out of and decoupled from the condenser section 154. It should also be noted that the method 358, in which the panels are inserted into the condenser section 154 one at a time, enables easier installation of the divider panel assembly 152. For example, having enough space to accommodate for the length of each individual panel, rather than the first length 166 of the entire divider panel assembly 152, enables the divider panel assembly 152 to be installed into the condenser section 154. Thus, the embodiment of the divider panel assembly 152 as discussed herein enables the divider panel assembly 152 to be implemented to an HVAC system 150 having the condenser section 154 positioned adjacent to another component or structure.

Further, in some embodiments, the divider panel assembly 152 may be retrofit into existing HVAC systems 150. For example, in existing HVAC systems 150 having the support rail 176 and/or the bracket 180 in the condenser section 154, panels may be manufactured and installed into the condenser section 154 to implement the divider panel assembly 152 into the condenser section 154. As such, existing HVAC systems 150 that currently do not include a partition dividing the condenser section 154 may employ the divider panel assembly 152 described herein.

Embodiments of the present disclosure are directed to a divider panel assembly that is insertable into a condenser section of an HVAC system. The divider panel assembly may include a plurality of panels that are configured to couple to one another. Furthermore, each panel is configured to engage a support rail of the condenser section. When inserted, the divider panel assembly may divide the condenser section into two separate volumes, which may each have a respective set of fans. The sets of fans may be independently controllable to one another, and in some operating modes of the HVAC system, operation of at least one of the set of fans may be suspended. The air flow through the set of fans in operation may not be affected by the inactive set of fans, because the divider panel assembly blocks air from flowing between the two volumes. As such, the efficiency of the set of fans in operation and of the HVAC system is improved, and the divider panel assembly may reduce a cost associated with energy consumption of the HVAC system. It should be noted that the divider panel assembly may be easily insertable into and removable out of the condenser section. For this reason, the divider panel assembly facilitates modification of the condenser section after the HVAC system has been manufactured. As an example, the divider panel assembly may be inserted into an existing condenser section at a time to enable the HVAC system to operate efficiently after suspending operation of some of the fans of the condenser, and the divider panel assembly may be removed from the condenser section to reduce a complexity of the condenser section. In some embodiments, the divider panel assembly may be inserted into and/or removed from the condenser section one panel at a time to facilitate easier modification of the HVAC system. That is, the divider panel assembly may facilitate changing the functionality of the HVAC system without having to disassemble multiple components of the condenser section or having substantial room for moving the divider panel assembly. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be noted that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, and/or air conditioning (HVAC) system, comprising:

a condenser section; and a plurality of panels configured to abut one another in a common plane to form a divider panel assembly, wherein the divider panel assembly is configured to divide an interior volume of the condenser section into a first volume and a second volume, wherein the first volume is associated with a first set of condenser fans and the second volume is associated with a second set of condenser fans, wherein the first set of condenser fans and the second set of condenser fans are independently controllable.

2. The HVAC system of claim 1, wherein each panel of the plurality of panels includes a hook portion configured to engage with a channel of a support rail of the condenser section.

3. The HVAC system of claim 2, wherein the support rail is a component of a condenser fan deck of the condenser section.

4. The HVAC system of claim 2, wherein each panel of the plurality of panels includes a brace coupled thereto, wherein the brace and the hook portion are configured to capture the support rail in an installed configuration of the divider panel assembly.

5. The HVAC system of claim 1, wherein the plurality of panels includes an inner panel, an outer panel, and an intermediate panel.

6. The HVAC system of claim 1, wherein each panel of the plurality of panels includes an angled base surface configured to mate with a sloped base panel of the condenser section.

7. The HVAC system of claim 1, wherein a panel of the plurality of panels is configured to engage with a bracket of the condenser section to secure the plurality of panels within the condenser section.

8. The HVAC system of claim 1, comprising an end plate configured to couple to the condenser section and to one of the plurality of panels to secure the plurality of panels within the condenser section.

9. The HVAC system of claim 1, wherein the plurality of panels sequentially extends along the common plane from within the condenser section and toward an exterior of the condenser section.

10. A divider panel assembly for a heating, ventilation, and/or air conditioning (HVAC) system, comprising:

a plurality of panels configured to abut one another, wherein each panel of the plurality of panels includes a respective hook portion configured to engage with a support rail of a condenser section of the HVAC system; and a plurality of braces, wherein each brace of the plurality of braces is configured to couple to a respective panel of the plurality of panels and configured to capture the support rail between the brace and the respective panel.

11. The divider panel assembly of claim 10, wherein a first length of the divider panel assembly is substantially equal to a second length of the condenser section.

12. The divider panel assembly of claim 10, wherein each panel of the plurality of panels includes a channel configured to capture a protrusion extending from a base panel of the condenser section to restrict movement of the panel relative to the base panel.

13. The divider panel assembly of claim 10, wherein each brace of the plurality of braces is configured to couple to the respective panel of the plurality of panels to form a gap between the brace and the respective hook portion of the respective panel, wherein the gap is configured to receive the support rail.

14. The divider panel assembly of claim 13, wherein each brace of the plurality of braces includes a flange with a distal flange end angled away from a main body of the brace to facilitate insertion of the support rail into the gap.

15. The divider panel assembly of claim 10, wherein each brace of the plurality of braces includes a first portion configured to fasten to the respective panel of the plurality of panels, a second portion angled relative to the first portion along a lateral axis, and a third portion oriented substantially parallel to the first portion and configured to abut the support rail in an installed configuration of the divider panel assembly.

16. The divider panel assembly of claim 15, wherein the second portion is oriented at an angle between 30 degrees and 60 degrees relative to the first portion.

17. The divider panel assembly of claim 10, wherein each panel of the plurality of panels includes a set of flanges, and respective sets of flanges of the plurality of panels are configured to couple to one another to couple the plurality of panels together.

18. A condenser section of a heating, ventilation, and/or air conditioning (HVAC) system, comprising:

a fan deck;

a support rail coupled to the fan deck and including a channel having a J-shape; and a panel of a divider panel assembly that is insertable into the condenser section and removable from the condenser section, wherein the panel includes a hook configured to slidably insert into the channel to engage the panel with the support rail, and the panel is configured to extend within the condenser section between a first interior volume and a second interior volume of the condenser section.

19. The condenser section of claim 18, wherein the panel is one of a plurality of panels configured to couple to one another to form the divider panel assembly.

20. The condenser section of claim 19, comprising a bracket having a recess, wherein the panel of the plurality of panels is configured to be inserted into the recess and abut the bracket.

21. The condenser section of claim 20, wherein the panel is a first panel, and the condenser section includes an end plate configured to abut a second panel of the plurality of panels.

22. The condenser section of claim 21, wherein the channel includes a flange configured to couple to the end plate.

23. The condenser section of claim 18, comprising a base panel, wherein the divider panel assembly includes a base surface having a geometry configured to substantially match with a profile of the base panel.

24. The condenser section of claim 23, wherein the base panel includes a protrusion, and the base surface of the divider panel assembly has an additional channel configured to capture the protrusion.

25. The condenser section of claim 19, comprising a brace configured to couple to the panel and capture the support rail between the brace and the panel.

* * * * *